United States Patent [19]

Anderson

[11] 4,099,755

[45] Jul. 11, 1978

[54] RELEASABLE MAGNET ASSEMBLY

[76] Inventor: Keith J. Anderson, 5049 Guerin Pass, New Berlin, Wis. 53151

[21] Appl. No.: 749,355

[22] Filed: Dec. 10, 1976

[51] Int. Cl.[2] ..... E05C 17/56

[52] U.S. Cl. ..... 292/251.5

[58] Field of Search ..... 292/251.5, 144, 201

[56] References Cited

U.S. PATENT DOCUMENTS

| | | | |
|---|---|---|---|
| 2,117,132 | 5/1938 | Baermann, Jr. | 292/251.5 |
| 3,288,511 | 11/1966 | Tavano | 292/251.5 |
| 3,691,688 | 9/1972 | Kaiserswerth | 292/251.5 |

FOREIGN PATENT DOCUMENTS

| | | | |
|---|---|---|---|
| 618,313 | 3/1961 | Italy | 292/251.5 |

*Primary Examiner*—Richard E. Moore
*Attorney, Agent, or Firm*—Quarles & Brady

[57] ABSTRACT

Several forms of releasable magnet door latches are disclosed. In one embodiment, a pull on a knob mounted in a housing attached to a door is translated by an inclined cam surface into rotary motion of an actuator rod extending into the door. The rod mounts a horseshoe magnet which is rotated with rotation of the rod. An intermediate member is mounted on the opposite surface of the door and contains a pair of ferromagnetic pole pieces which are spaced from each other and which act as extension of the poles of the horseshoe magnet in the ON position of the magnet. In such position, the magnet attracts a ferromagnetic plate mounted on the door frame. The intermediate member also contains a transverse shunt piece which bridges the poles of the magnet when the magnet has been rotated through an arc of 90° to an OFF position. In the other embodiments, a rectangular permanent magnet having poles formed on opposite side surfaces has a pair of pole plates disposed on such side surfaces. The intermediate member mounted in the door contains a pair of spaced shunt bars which are aligned with the pole pieces to act as extensions thereof in the ON position, and which, upon the rotation of the magnet by the turning of a handle, bridge the pair of poles pieces to shunt the magnetic flux. In one of the other embodiments, the magnet and its pole pieces and the intermediate member constitute a subassembly in which extensions of the pole pieces are rotatably mounted within a central opening in the intermediate member and are restrained axially in such opening.

12 Claims, 9 Drawing Figures

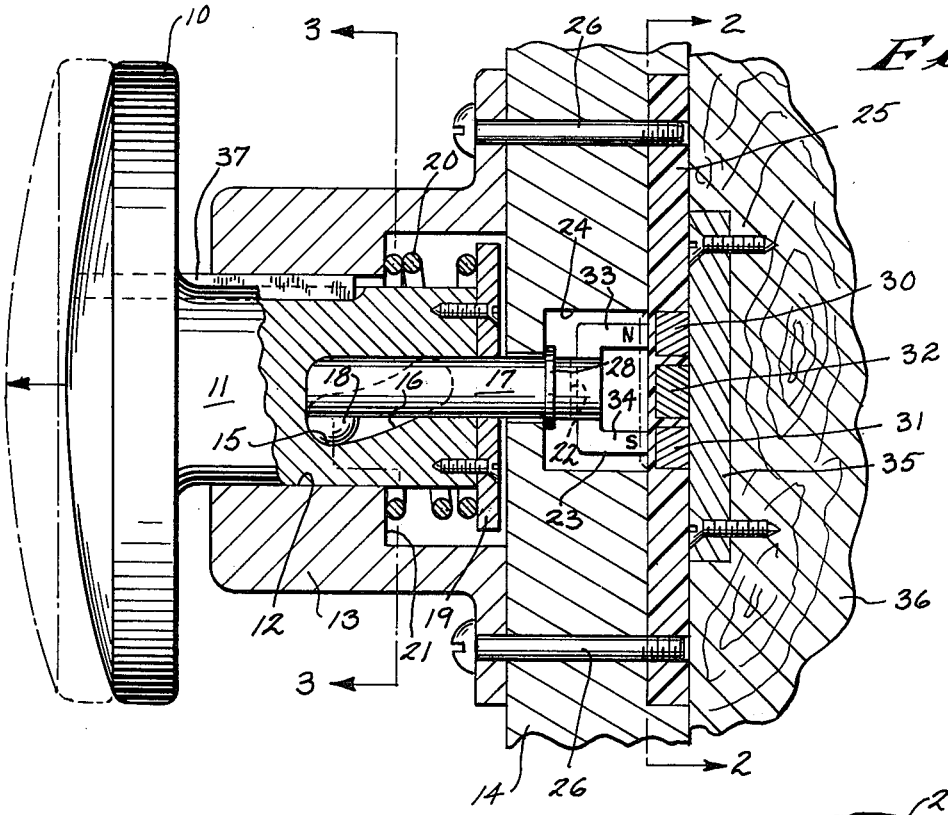
Fig. 1
Fig. 3
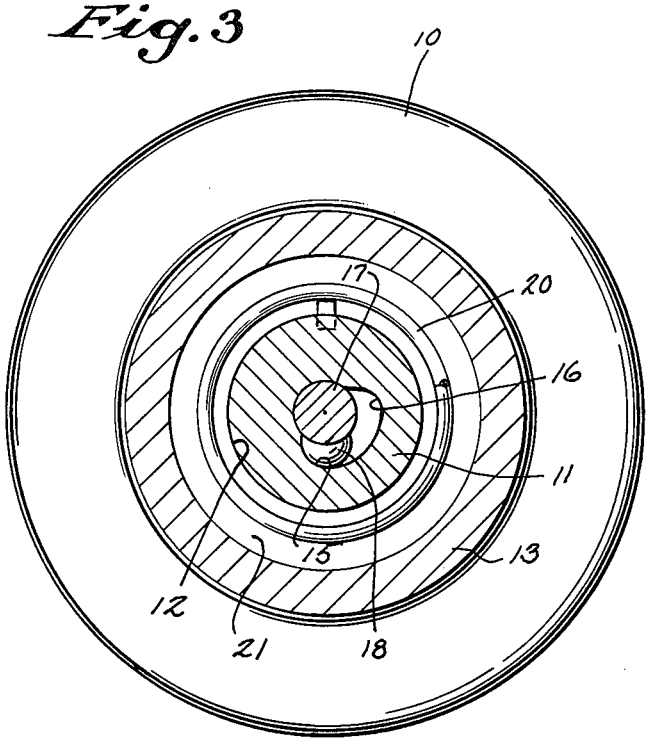
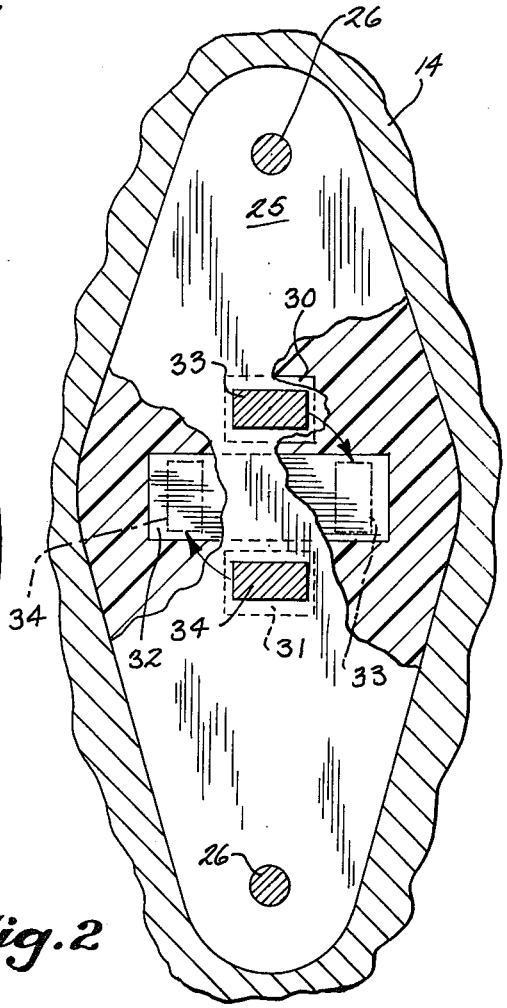
Fig. 2

Fig.4
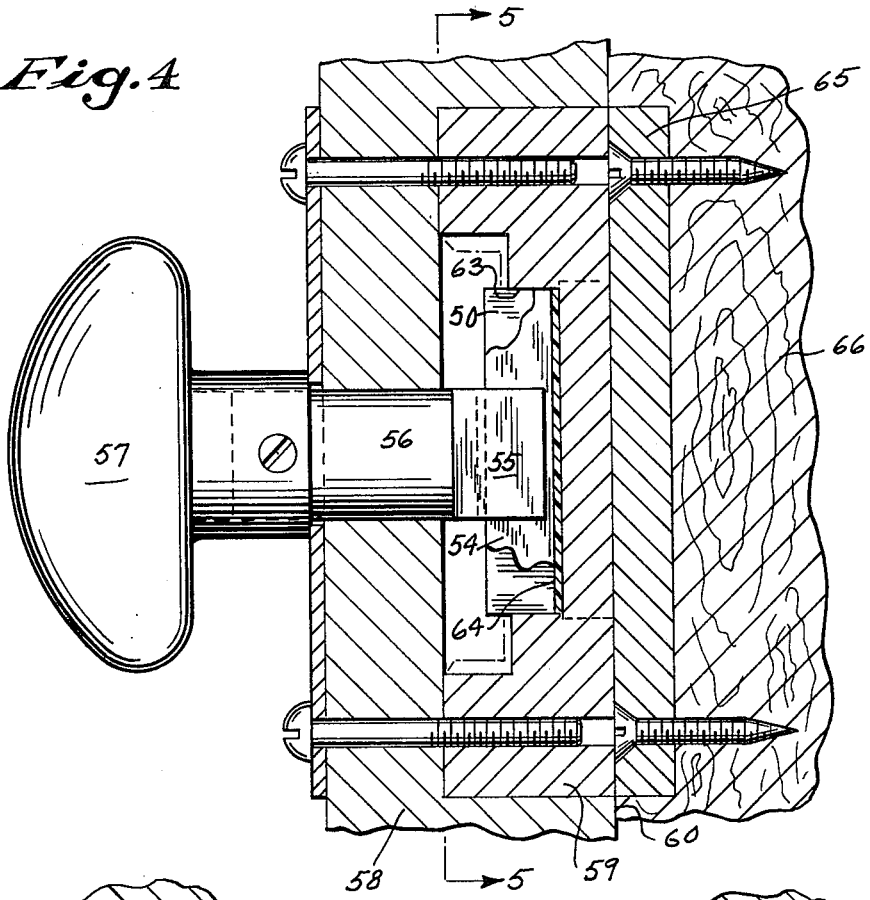
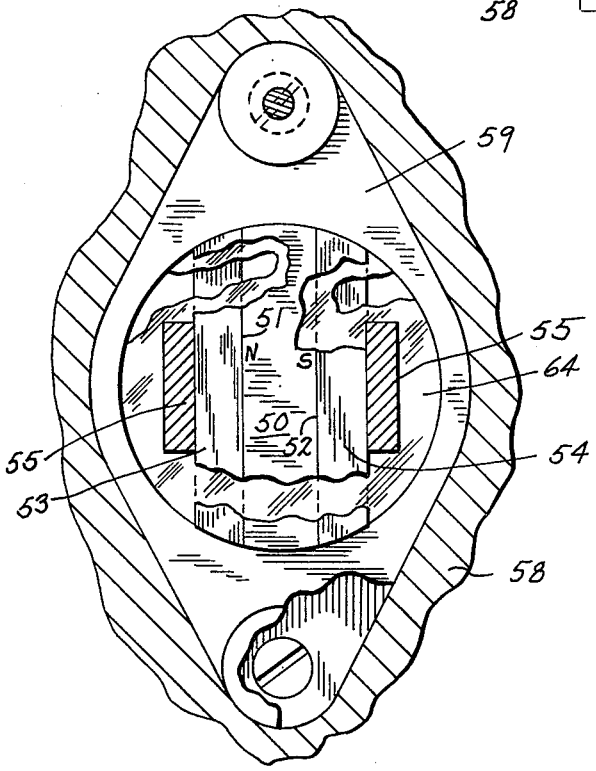
Fig.5
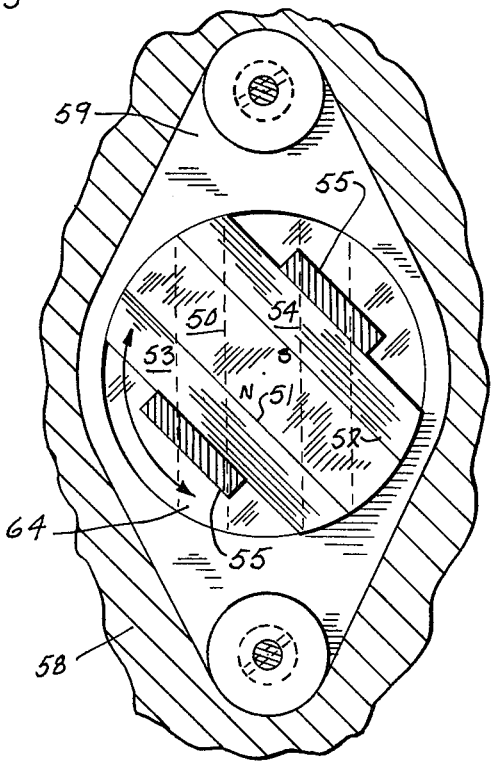
Fig.6

RELEASABLE MAGNET ASSEMBLY

BACKGROUND OF THE INVENTION

This invention relates to magnet assemblies, and more particularly to an assembly in which the flux field of a magnet which normally attracts a ferromagnetic member can be shunted upon relative rotation of the magnet and a shunt member.

Permanent magnet assemblies which can be turned on and off by shifting elements relative to each other have been used in the past for chucks or work holders. Examples are found in U.S. Pat. No. 2,053,177 to Bower, issued Sept. 1, 1936, in which permanent magnets are shifted longitudinally between ON and OFF positions. In the ON position the poles of the magnet are aligned with pole pieces in the surface of the work holder. In the OFF position each pole piece bridges and thereby shunts a pair of magnetic poles. U.S. Pat. No. 2,187,240, issued Jan. 16, 1940 to Karasick, employs two rows of magnets and one row is shifted relative to the other to accomplish the turning ON and OFF of a chuck. U.S. Pat. No. 2,209,558 issued July 30, 1940 to Bing et al uses generally cylindrical permanent magnets which are rotated about their longitudinal axis within pole pieces to turn the chuck ON and OFF.

Another form of magnetic work holder is disclosed in U.S. Pat. No. 3,121,193, issued Feb. 11, 1964 to Engelsted et al. In such patent, alternate layers of ferromagnetic pole pieces and non-ferromagnetic spacers form a disc-like upper working surface. Beneath this upper working surface are alternate layers of permanent magnets and pole pieces. When the permanent magnets are aligned beneath the pole pieces of the upper layer, the work holder is ON. The work holder is turned OFF by angularly rotating the lower assembly of permanent magnets and pole pieces so that the upper pole pieces lie across several permanent magnets and thereby shunt the magnetic flux.

Each of the chucks or work holders use a large number of magnet poles and shunt pieces to exert a magnetic force over a relatively large surface area.

I have provided a permanent magnet assembly using a single pair of magnet poles which can be urged ON and OFF by relative angular rotation between the magnet and ferromagnetic members which act as pole extensions in one position and shunt the magnetic flux when in another relative angular position. The permanent magnet assembly is particularly useful as a door or cabinet latch.

Magnetic door and cabinet latches which are presently available simply mount a permanent magnet either on the door or the frame and mount a ferromagnetic plate where it can be contacted by the magnet when the door is closed. In some cases, the door or frame is itself formed of a ferromagnetic material so that a separate plate is not needed. While such existing latches are very simple in construction, they require for release the direct application of a manual force to overcome the magnetic attraction. As a result the latches are necessarily restricted in the attractive force which they can use.

SUMMARY OF THE INVENTION

In accordance with my invention I provide a releasable latch adapted to cooperate with a ferromagnetic strike piece mounted on either the door or door frame, and including a magnet mounted in the other of the door or frame and having spaced poles, an intermediate member disposed between the magnet and the strike piece and including ferromagnetic means acting as an extension of the poles of the magnet when the magnet is in one position and acting as a shunt across the poles of said magnet when the magnet and intermediate member are moved angularly through an arc relative to each other, together with means for moving the magnet and intermediate member relative to each other.

Further in accordance with my invention, I provide a permanent magnet assembly which includes a rectangular permanent magnet having opposite poles on a pair of opposite side surfaces, a pair of pole plates each disposed against one of said side surfaces and each having an extension on one edge projecting beyond the magnet, together with a shunt member which includes a pair of ferromagnetic bars which are spaced apart for alignment with the pole plates, and which also includes means for receiving the extensions of the pole plates for rotatably mounting the shunt member on said extensions and for axially restraining the shunt member with respect to the pole plates.

A door latch in accordance with my invention is simple in construction and operation and yet provides a very positive release upon rotary motion of the permanent magnet and shunt member relative to each other. The rotary motion may be provided directly by a manual rotation of a handle connected to the magnet or may be provided by translating an axial motion into rotary motion of the permanent magnet. Because the latch magnet may be turned between definite ON and OFF positions, it does not require a large manual force to overcome the pull of the magnet. The only force required is that necessary to turn the permanent magnet relative to the shunt members. As a result larger, more powerful magnets can be used to provide a greater latching force, while requiring less force for their release.

The permanent magnet assemblies disclosed herein, while particularly useful as latches, are not limited to such uses. They may, for example, be used in installations in which it is desired to releasably couple two members to each other.

The foregoing and other objects and advantages of this invention will appear in the detailed description which follows. In the description reference is made to the accompanying drawings which illustrate several preferred embodiments of the invention.

BRIEF DESCRIPTION OF THE DRAWINGS

FIG. 1 is a view in vertical section through a first embodiment of a door latch in accordance with the present invention;

FIG. 2 is a view in elevation, with portions broken away for illustration, of the intermediate member of the latch of FIG. 1 and viewed in the plane of line 2—2 of FIG. 1;

FIG. 3 is a view in vertical section taken in the plane of the line 3—3 of FIG. 1;

FIG. 4 is a view in vertical section taken through a second embodiment of a latch in accordance with the present invention;

FIG. 5 is a view in elevation taken in the plane of the line 5—5 of FIG. 4 and with parts broken away for purposes of illustration;

FIG. 6 is a view similar to FIG. 5 but showing the magnet assembly rotated to an OFF position relative to the intermediate member;

DESCRIPTION OF THE PREFERRED EMBODIMENTS

Figure 7:
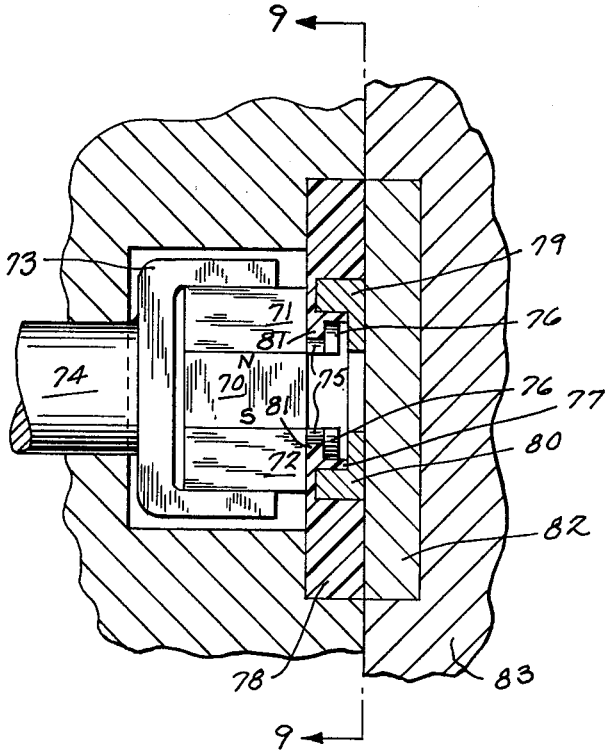
FIG. 7 is a view in vertical section taken through a latch incorporating the present invention.

Referring to FIGS. 1, 2 and 3, the first embodiment of a latch is adapted to be released by an axial pull on a knob 10 which is mounted on the end of a cylindrical stem 11 received within a bore 12 of a housing 13. The housing would typically be attached to the outside of a door 14. The stem 11 contains a central bore having an axially extending semi-circular keyway 15 along one side. The keyway 15 connects with an inclined cam surface 16. An actuator rod 17 is received in the bore of the stem 11 and is provided with a hemispherical protuberance 18 at one end which acts as a cam follower. The rod 17 can be inserted into the stem 11 with the cam follower 18 passing down the keyway 15 until it is seated in the cam surface 16. A bearing plate 19 is attached to the inner end of the stem 11 and a compression spring 20 is disposed between the bearing plate 19 and a wall 21 in a recess of the housing 13 so as to urge the stem 11 and knob 10 inwardly towards the surface of the door 14. The bearing plate 19 is provided with an opening (not shown) which matches the keyway 15 of the stem 11 so as to allow the insertion of the cam follower 18 of the rod 17.

The opposite end of the follower rod 17 is provided with a transfer slot 22 which receives the bite portion of a horseshoe magnet 23. The magnet 23 is received in a recess 24 formed in the door and is disposed behind an intermediate member 25 mounted flush with the surface of the door 14. Through bolts 26 may be used to attach the housing 13 and the intermediate member 25 together on the door 14.

The actuator rod 17 extends through a central opening 27 provided in the opposite surface of the door 14. The rod 17 contains an intermediate shoulder 28 which operates against the bottom of the recess 24 to prevent axial withdrawalof the rod 17 as the knob 10 is pulled outwardly.

The intermediate member 25 is formed of a material of low magnetic permeability containing ferromagnetic inserts. The ferromagnetic inserts comprise a pair of spaced pole pieces 30 and 31 and a transverse shunt piece 32 extending in the space between the pole pieces 30 and 31. In the position shown in FIG. 1, which is the same position shown in solid lines in FIG. 2, the spaced north and south poles 33 and 34, respectively, of the magnet 23 are aligned with the pole pieces 30 and 31 and the pole pieces will function as extensions of the poles 33 and 34. With the door 14 closed, the magnetic flux from the respective north 33 and south 34 poles of the magnet 23 will be directed through the pole pieces 30 and 31 into a ferromagnetic strike plate 35 mounted in the frame 36 of the doorway. This is the ON position of the latch.

Upon pulling the knob 10 outwardly, the actuator rod 17 will be rotated as the cam follower 18 rides the inclined cam surface 16 thereby rotating the magnet 23. Upon rotation of the magnet 23 through an arc of 90°, the poles 33 and 34 of the magnet will now overlie the ends of the shunt piece 32 and the magnetic flux from the poles will be shunted through the shunt piece 32 and will no longer attract the strike piece 35. In this position, the latch is OFF and the door is free to be swung away from its frame 36.

The pole pieces 30 and 31 and shunt piece 32 do not extend to the interior surface of the intermediate member 25. Instead, a layer of the material of low permeability is left and this layer functions as a bearing surface for the ends of the permanent magnet 23. Such bearing surface will reduce the drag of the poles 33 and 34 of the permanent magnet as they are rotated to release the latch so that only a nominal mechanical force is needed to turn the latch between ON and OFF positions.

Depending upon the inclination of the cam surface 16 and the frictional engagement of the compression spring 20 with the housing 13 and bearing plate 19, it is possible to rotate the knob 10 and exert sufficient force upon the actuator rod 17 to cause the rod 17 and the magnet 23 to rotate. Thus, in the first embodiment the latch could be turned to an OFF position either by pulling the knob 10 or by rotating the knob through 90°. If it is desired to prevent a rotary motion from actuating the latch, a removable square key 37 may be used to join the stem 11 to the housing 13 to allow only an axial movement of the stem 11.

In the first embodiment, the pole pieces 30 and 31 and the shunt pieces 32 are preferably formed of an inexpensive material having a high magnetic permeability, such as a low carbon steel. The remainder of the intermediate member 25 acts essentially as a magnetic insulator to separate the pole pieces 30 and 31 from each other and from the shunt piece 32, and also to provide a bearing surface against which the poles 33 and 34 of the magnet 23 can operate. The body of the intermediate member 25 may be formed of a number of materials of low magnetic permeability such as brass. However, it is preferable to form it of a cast or molded plastic which provides both the necessary magnetic insulation and a suitable bearing surface.

In the embodiment of FIG. 4, a rectangular permanent magnet 50, such as a ferrite magnet, is employed in place of the horseshoe magnet of the first embodiment. The rectangular permanent magnet 50 is formed with opposite poles on its opposite side surfaces 51 and 52. Attached to each side surface, and therefore each pole, is a ferromagnetic pole piece 53 and 54, respectively. The assemblage of the magnet 50 and pole pieces 53 and 54 is grasped by the spaced fingers 55 of a yoke formed on one end of the spindle 56 of a handle 57. The magnet 50 and its pole pieces 53 and 54 are disposed within a cavity in a door 58 which is closed by an intermediate member 59 having an outer surface 60 which is flush with the surface of the door 58. The intermediate member 59 is formed of a material of low magnetic permeability and contains a pair of spaced ferromagnetic shunt bars 61 and 62, respectively. The shunt bars 61 and 62 are spaced apart a distance which is the same as the spacing of the pole pieces 53 and 54. In the ON position of the magnet assembly, the pole pieces 53 and 54 are aligned with the shunt bars 61 and 62.

The intermediate member 59 is provided with a circular counter bore 63 which receives and seats the magnet 50 and its pole pieces 53 and 54. The ends of the magnet and pole pieces are shaped to conform with the cylindrical inner surface of the bore 63. A sheet of a low friction material, which is also of low magnetic permeability, is disposed between the magnet 50 and its pole pieces 53 and 54, and the intermediate member 59. The sheet 64 may be of a plastic material such as a polyester.

When the pole pieces 53 and 54 are aligned with the shunt bars 61 and 62, magnetic flux will flow through the pole pieces and shunt bars and attract a ferromagnetic strike plate 65 mounted in the surface of the door frame 66. Upon rotating the magnet assembly through an arc of about 45° by turning the handle 57, the shunt bars 61 and 62 will overlie the pole pieces 53 and 54 at both ends and constitute a shunt for the magnetic flux (see FIG. 6). This will release the magnetic attraction of the latch against the strike plate 65 and release the door 58.

Figure 8:
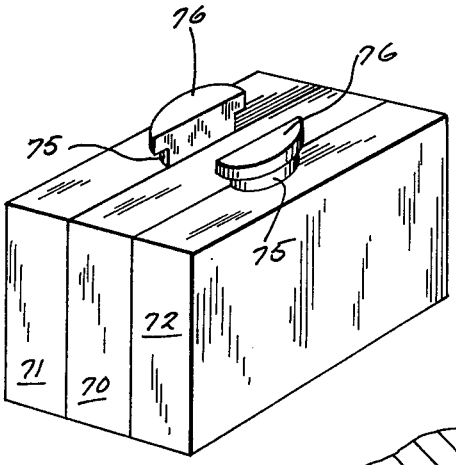
FIG. 8 is a view in perspective of the magnet and pole pieces of the magnet assembly of latch of FIG. 7.
Figure 9:
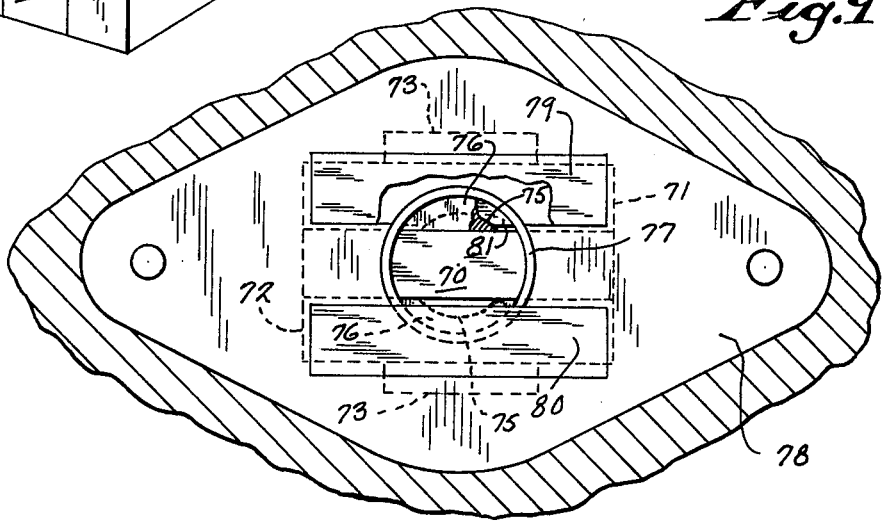
FIG. 9 is a view in elevation of the latch of FIG. 7 and taken in the plane of the line 9—9 of FIG. 7.

The third embodiment shown in FIGS. 7, 8 and 9 is similar to the second embodiment in that it employs a rectangular permanent magnet 70 with a pair of pole pieces 71 and 72 joined to opposite side surfaces which are formed as the poles of the magnet 70. Further as in the second embodiment, the assembly of the magnet 70 and the pole pieces 71 and 72 is grasped by the bifurcated end 73 on a spindle 74 connected to a handle which can be rotated.

In the third embodiment, each of the pole pieces 71 and 72 is formed with an extension on one edge projecting beyond the like edge of the permanent magnet 70. Each projection includes a stem portion 75 and an overlying and outwardly extending roof 76. Both the stem portion 75 and roof 76 are formed as portions of circular cylinders. The extensions of the pole pieces 71 and 72 are adapted to be received within a generally circular cylindrical hollow bearing 77 formed centrally of an intermediate member 78. The bearing 77 is centered between and beneath a pair of shunt pieces 79 and 80, respectively, which are disposed within the body of the intermediate member 78. The intermediate member 78 is preferably formed of a low friction, low magnetic permeability, material and has integral inwardly projecting lips 81 on opposite sides of the opening 77. The lips 81 are adapted to be received in the undercut portions defined by the overlying roofs 76 and stems 75 of the extensions. As with the second embodiment, in the ON position of the latch, the pole pieces 71 and 72 are aligned with the shunt pieces 79 and 80 so that the shunt pieces act as extensions of the poles of the magnet 70. In such position, the latch is attracted to a ferromagnetic strike plate 82 mounted on the door frame 83. Rotation of the spindle 73, and thereby the magnet 70, will cause the shunt pieces 79 and 80 to bridge the pole pieces 71 and 72 and thereby shunt the magnetic flux and cause the latch to release the strike plate 80.

The magnet 70 with its pole pieces, and the intermediate member 81, may be initially assembled as a unit and used and installed as such. The procedure for assembly involves first placing the extensions of the pole pieces 71 and 72 into the bearing opening 77. Then, the permanent magnet 70 is slid between the pole pieces 71 and 72. The pole pieces 71 and 72 are now joined to the magnet 70 by the attractive force of the magnet. The pole pieces 71 and 72 together with the magnet 70 are restrained axially with respect to the intermediate member 81 by the engagement of the overlying roof portions 76 with the lips 76 and the assembly can rotate within the intermediate member 81. A complete assembly is thus provided in which the permanent magnet acts as a keystone.

In each instance the magnet used in the latch and magnet assembly is preferably a permanent magnet. That is, it is capable of maintaining a magnetic field at other than cyrogenic temperatures with no expenditure of power.

Although the preferred embodiments show the magnet assembly mounted in the door, the magnet assembly could be mounted in the door frame and the strike plate mounted on the door. Door and door frame as used herein are not intended to limit the use of the latch to a door in the narrow sense. Rather, any two elements which are desired to be latched or coupled together may effectively employ the releasable magnet assembly of this invention. For example, the latch could be used on a drawer. Furthermore, although each of the preferred embodiments employs a mechanism to rotate the magnet relative to the intermediate member, the latches could be modified to provide a mechanism to rotate the intermediate member in relation to a stationary magnet.

I claim:

1. A releasable latch comprising:

a strike plate of high magnetic permeability adapted to be mounted on one of a door and the frame of the door;

a magnet mounted for rotation in the other of said door and door frame and having spaced poles;

an intermediate member secured to said other of said door and door frame and disposed between said magnet and said strike plate, said intermediate member including ferromagnetic means acting as an extension of said poles when said magnet is in one relative angular position with respect to said intermediate member and acting as a shunt when said magnet and said intermediate member have been rotated through an arc relative to each other;

means for rotating one of said intermediate member and said magnet relative to the other through said arc, said rotating means having an axis of rotation normal to said intermediate member and said magnet poles being disposed on opposite sides of said axis of rotation; and a layer of low friction material disposed between said magnet poles and said ferromagnetic means.

2. A releasable latch in accordance with claim 1, wherein:

said magnet is a horseshoe magnet whose spaced poles are defined by spaced arms;

said ferromagnetic means comprises a pair of spaced pole pieces adapted to be aligned with the ends of the spaced arms of the horseshoe magnet when said magnet is in one relative angular position, and a shunt bar disposed between and spaced from said pair of pole pieces and adapted to bridge the ends of the arms of the horseshoe magnet when said magnet and said intermediate member have been rotated relative to each other through said arc.

3. A releasable latch in accordance with claim 1, wherein:

said magnet is a rectangular permanent magnet having its spaced poles on opposite side surfaces, together with a pair of ferromagnetic pole plates each of which is disposed against one of said side surfaces; and said ferromagnetic means comprises a pair of spaced bars which are longitudinally aligned with said pole plates of said magnet when said magnet is in one relative angular position and which bridge said pole pieces when said magnet and said intermediate member have been rotated relative to each other through said arc.

4. A releasable latch in accordance with claim 1, wherein said rotating means includes a rod grasping said magnet and extending along said axis of rotation, a knob aligned with said axis of rotation and adapted for movement along said axis, and means for translating the linear movement of said knob into rotation of said rod.

5. A releasable latch in accordance with claim 1, wherein said rotating means includes a spindle mounted for rotation and extending along said axis of rotation, said spindle grasping said magnet at one end and having a handle mounted at its opposite end.

6. A releasable door latch, comprising:

a ferromagnetic strike plate adapted to be mounted on the frame of a door;

an intermediate member adapted to be mounted on a surface of the door for contact with said strike plate when said door is closed;

a magnet mounted for rotation about an axis normal to said intermediate member and disposed within a recess in said door behind said intermediate member;

said magnet having spaced poles and said intermediate member including ferromagnetic means which are extensions of said poles when said magnet is in one relative angular position with respect to said intermediate member and which shunts the poles of said magnet when said magnet has been rotated through an arc relative to said intermediate member;

a rotatable member grasping said magnet at one of its ends and extending along said axis of rotation and projecting outwardly of said door away from said intermediate member; and means for rotating said rotatable member in response to external actuation to move said magnet through said arc.

7. A door latch in accordance with claim 6, wherein said intermediate member is formed of a plastic material with said ferromagnetic means embedded in said plastic material, and wherein a layer of said plastic material is provided between said ferromagnetic means and said magnet poles.

8. A door latch in accordance with claim 6 wherein a layer of low friction material having low magnetic permeability is disposed between said magnet poles and said ferromagnetic means.

9. A door latch in accordance with claim 6, together with a housing attached to the surface of said door and surrounding the projecting end of said rotatable member;

a knob having a cylindrical stem mounted for movement in said housing and including an internal, inclined cam surface, said rotatable member having a cam follower in contact with said cam surface whereby axial movement of said knob and stem will be translated into rotation of said spindle; and a spring normally urging said knob and stem toward said door.

10. A latch in accordance with claim 7, together with a handle mounted on the projecting end of said rotatable member.

11. A magnet assembly, comprising:

a rectangular permanent magnet having opposite poles on a pair of opposite side surfaces;

a pair of ferromagnetic pole plates each disposed against one of said side surfaces and with each pole plate having an extension on one edge, said extensions projecting beyond said magnet; and a shunt member including a pair of ferromagnetic bars which are spaced apart and are adapted to be aligned with said pole plates when said bars and said pole plates are in the same relative angular position, said shunt member including mounting means receiving the extensions of said pole plates for rotatably mounting said shunt member on said extensions and for axially restraining said shunt member with respect to said pole plates and magnet.

12. A magnet assembly in accordance with claim 11, wherein said mounting means includes a rounded opening in said shunt member between said bars and inwardly extending portions on opposite sides of said opening; and said extensions each include a rounded portion adapted to mate with a side of said opening and an undercut portion adapted to receive a respective one of said inwardly extending portions.

* * * * *